US007799175B2

(12) United States Patent
Hansen

(10) Patent No.: US 7,799,175 B2
(45) **Date of Patent: *Sep. 21, 2010**

(54) PASSIVE SENSOR SYSTEM FOR DETECTION OF WEAR PROBLEMS IN PAPER MACHINE CLOTHING

(75) Inventor: Robert A. Hansen, Stuttgart-Birkach (DE)

(73) Assignee: Albany International Corp., Albany, NY (US)

( * ) Notice: Subject to any disclaimer, the term of this patent is extended or adjusted under 35 U.S.C. 154(b) by 853 days.

This patent is subject to a terminal disclaimer.

(21) Appl. No.: 10/581,627

(22) PCT Filed: Dec. 11, 2003

(86) PCT No.: PCT/US03/39438

§ 371 (c)(1),
(2), (4) Date: Apr. 10, 2007

(87) PCT Pub. No.: WO2005/061787

PCT Pub. Date: Jul. 7, 2005

(65) Prior Publication Data

US 2008/0026194 A1 Jan. 31, 2008

Related U.S. Application Data

(63) Continuation-in-part of application No. 10/295,085, filed on Nov. 15, 2002, now Pat. No. 7,407,564.

(51) Int. Cl.
*D21F 7/08* (2006.01)
*B32B 5/02* (2006.01)

(52) U.S. Cl. ..... 162/358.2; 162/199; 162/900; 442/270; 442/271

(58) Field of Classification Search ..... 162/116, 162/348, 358.1, 358.2, 361, 900–904, 199, 162/362, 358.4, 306; 139/383 A, 425 A; 442/270, 272, 274, 187, 188; 428/212; 28/110, 28/141, 142
See application file for complete search history.

(56) References Cited

U.S. PATENT DOCUMENTS 2,165,772 A 7/1939 Walsh et al.

(Continued)

FOREIGN PATENT DOCUMENTS

DE 38 00 278 A 8/1988

(Continued)

OTHER PUBLICATIONS

JP 2003-049381, Feb. 2003, JPO Machine Translation.*

(Continued)

*Primary Examiner*—Eric Hug
(74) *Attorney, Agent, or Firm*—Frommer Lawrence & Haug LLP; Ronald R. Santucci

(57) ABSTRACT

A stratified press fabric for the press section of a paper machine having a passive sensor system for detecting wear in the press fabric. The lower (non-surface) layer(s) of the stratified press fabric are produced using colored staple fiber batt material. As the surface of the fabric is worn away through use, the colored batt material is exposed to provide a visual indication of the wear. This visual indication allows the customer to readily determine the appropriate time to replace the press fabric.

17 Claims, 3 Drawing Sheets

U.S. PATENT DOCUMENTS

| | | | | | |
|---|---|---|---|---|---|
| 3,009,234 | A | * | 11/1961 | Blackburn et al. | 28/166 |
| 3,392,079 | A | | 7/1968 | Fekete | |
| 3,613,258 | A | | 10/1971 | Jamieson | |
| 3,657,068 | A | | 4/1972 | Ivanowicz | |
| 3,928,699 | A | | 12/1975 | Fekete | |
| 4,162,190 | A | | 7/1979 | Ashworth | |
| 4,283,454 | A | | 8/1981 | Buchanan | |
| 4,283,455 | A | * | 8/1981 | McGee | 442/72 |
| 4,427,734 | A | | 1/1984 | Johnson | |
| 4,439,273 | A | | 3/1984 | Curry | |
| 4,500,588 | A | | 2/1985 | Lundstrom | |
| 4,503,113 | A | | 3/1985 | Smart | |
| 4,511,361 | A | * | 4/1985 | Shah | 8/471 |
| 4,781,967 | A | | 11/1988 | Legge et al. | |
| 4,798,760 | A | | 1/1989 | Diaz-Kotti | |
| 4,806,413 | A | | 2/1989 | Penven | |
| 4,830,905 | A | | 5/1989 | Gulya et al. | |
| 4,830,915 | A | | 5/1989 | Diaz-Kotti | |
| 4,892,781 | A | | 1/1990 | Penven | |
| 5,056,565 | A | | 10/1991 | Kufferath | |
| 5,135,802 | A | | 8/1992 | Gstrein et al. | |
| 5,232,768 | A | | 8/1993 | Eklund et al. | |
| 5,360,656 | A | | 11/1994 | Rexfelt et al. | |
| 5,945,358 | A | | 8/1999 | Marchand | |
| 6,140,260 | A | | 10/2000 | Johnson et al. | |
| 6,358,369 | B1 | | 3/2002 | Yoshida et al. | |
| 6,514,386 | B2 | | 2/2003 | Watanabe | |
| 6,712,940 | B2 | | 3/2004 | Crook | |
| 7,407,564 | B2 | * | 8/2008 | Hansen | 162/358.2 |
| 2002/0166601 | A1 | | 11/2002 | Best | |
| 2004/0129398 | A1 | * | 7/2004 | Munch et al. | 162/198 |
| 2004/0266296 | A1 | * | 12/2004 | Martinsson et al. | 442/192 |

FOREIGN PATENT DOCUMENTS

| | | | |
|---|---|---|---|
| GB | 2 315 499 | A | 2/1998 |
| JP | 2003-49381 | | 2/2003 |
| JP | 2003-49381 | A | 2/2003 |
| WO | WO 03/071030 | | 8/2003 |
| WO | WO 03/071030 | A | 8/2003 |
| WO | WO 03/085197 | | 10/2003 |

OTHER PUBLICATIONS

U.S. Standard Sieve Sizes.

* cited by examiner

PASSIVE SENSOR SYSTEM FOR DETECTION OF WEAR PROBLEMS IN PAPER MACHINE CLOTHING

FIELD OF THE INVENTION

This application is a 371 of PCT/US2003/039438 filed on Dec. 11, 2003, published on Jul. 7, 2005 under publication number WO 2005/061787 A1. In addition, this application is a continuation-in-part of U.S. patent application Ser. No. 10/295,085 filed Nov, 15, 2002 entitled "Stratified Press Fabric," which was granted as U.S. Pat. No. 7,407,564 on Aug. 5, 2008.

BACKGROUND OF THE INVENTION

Description of the Prior Art

During the papermaking process, a cellulosic fibrous web is formed by depositing a fibrous slurry, that is, an aqueous dispersion of cellulose fibers, onto a moving forming fabric in the forming section of a paper machine. A large amount of water is drained from the slurry through the forming fabric, leaving the cellulosic fibrous web on the surface of the forming fabric.

The newly formed cellulosic fibrous web proceeds from the forming section to a press section, which includes a series of press nips. The cellulosic fibrous web passes through the press nips supported by a press fabric, or, as is often the case, between two such press fabrics. In the press nips, the cellulosic fibrous web is subjected to compressive forces which squeeze water therefrom, and which adhere the cellulosic fibers in the web to one another to turn the cellulosic fibrous web into a paper sheet. The water is accepted by the press fabric or fabrics and, ideally, does not return to the paper sheet.

The paper sheet finally proceeds to a dryer section, which includes at least one series of rotatable dryer drums or cylinders, which are internally heated by steam. The newly formed paper sheet is directed in a serpentine path sequentially around each in the series of drums by a dryer fabric, which holds the paper sheet closely against the surfaces of the drums. The heated drums reduce the water content of the paper sheet to a desirable level through evaporation.

It should be appreciated that the forming, press and dryer fabrics all take the form of endless loops on the paper machine and function in the manner of conveyors. It should further be appreciated that paper manufacture is a continuous process which proceeds at considerable speeds. That is to say, the fibrous slurry is continuously deposited onto the forming fabric in the forming section, while a newly manufactured paper sheet is continuously wound onto rolls after it exits from the dryer section.

The present invention relates specifically to the press fabrics used in the press section. Press fabrics play a critical role during the paper manufacturing process. One of their functions, as implied above, is to support and to carry the paper product being manufactured through the press nips.

Press fabrics also participate in the finishing of the surface of the paper sheet. That is, press fabrics are designed to have smooth surfaces and uniformly resilient structures, so that, in the course of passing through the press nips, a smooth, mark-free surface is imparted to the paper.

Perhaps most importantly, the press fabrics accept the large quantities of water extracted from the wet paper in the press nip. In order to fulfill this function, there literally must be space, commonly referred to as void volume, within the press fabric for the water to go, and the fabric must have adequate permeability to both water and air for its entire useful life. Finally, press fabrics must be able to prevent the water accepted from the wet paper from returning to and rewetting the paper upon exit from the press nip.

Contemporary press fabrics are produced in a wide variety of styles designed to meet the requirements of the paper machines on which they are installed for the paper grades being manufactured. Generally, they comprise a woven base fabric into which has been needled a batt of fine, nonwoven fibrous material. The base fabrics may be woven from monofilament, plied monofilament, multifilament or plied multifilament yarns, and may be single-layered, multi-layered or laminated. The yams are typically extruded from any one of the synthetic polymeric resins, such as polyamide and polyester resins, used for this purpose by those of ordinary skill in the paper machine clothing arts.

The woven base fabrics themselves take many different forms. For example, they may be woven endless, or flat woven and subsequently rendered into endless form with a woven seam. Alternatively, they may be produced by a process commonly known as modified endless weaving, wherein the widthwise edges of the base fabric are provided with seaming loops using the machine-direction (MD) yarns thereof. In this process, the MD yarns weave continuously back-and-forth between the widthwise edges of the fabric, at each edge turning back and forming a seaming loop. A base fabric produced in this fashion is placed into endless form during installation on a paper machine, and for this reason is referred to as an on-machine-seamable fabric. To place such a fabric into endless form, the two widthwise edges are brought together, the seaming loops at the two edges are interdigitated with one another, and a seaming pin or pintle is directed through the passage formed by the interdigitated seaming loops.

Further, the woven base fabrics may be laminated by placing at least one base fabric within the endless loop formed by another, and by needling a staple fiber batt through these base fabrics to join them to one another. One or more of these woven base fabrics may be of the on-machine-seamable type. This is now a well known laminated press fabric with a multiple base support structure.

In any event, the woven base fabrics are in the form of endless loops, or are seamable into such forms, having a specific length, measured longitudinally therearound, and a specific width, measured transversely thereacross. Because paper machine configurations vary widely, paper machine clothing manufacturers are required to produce press fabrics, and other paper machine clothing, to the dimensions required to fit particular positions in the paper machines of their customers. Needless to say, this requirement makes it difficult to streamline the manufacturing process, as each press fabric must typically be made to order.

In response to this need to produce press fabrics in a variety of lengths and widths more quickly and efficiently, press fabrics have been produced in recent years using a spiral technique disclosed in commonly assigned U.S. Pat. No. 5,360,656 to Rexfelt et al., the teachings of which are incorporated herein by reference.

U.S. Pat. No. 5,360,656 shows a press fabric comprising a base fabric having one or more layers of staple fiber material needled thereinto. The base fabric comprises at least one layer composed of a spirally wound strip of woven fabric having a width which is smaller than the width of the base fabric. The base fabric is endless in the longitudinal, or machine, direction. Lengthwise threads of the spirally wound strip make an angle with the longitudinal direction of the press fabric. The strip of woven fabric may be flat-woven on a loom which is narrower than those typically used in the production of paper machine clothing.

The base fabric comprises a plurality of spirally wound and joined turns of the relatively narrow woven fabric strip. The fabric strip is woven from lengthwise (warp) and crosswise (filling) yarns. Adjacent turns of the spirally wound fabric strip may be abutted against one another, and the helically continuous seam so produced may be closed by sewing, stitching, melting or welding. Alternatively, adjacent longitudinal edge portions of adjoining spiral turns may be arranged overlappingly, so long as the edges have a reduced thickness, so as not to give rise to an increased thickness in the area of the overlap. Further, the spacing between lengthwise yarns may be increased at the edges of the strip, so that, when adjoining spiral turns are arranged overlappingly, there may be an unchanged spacing between lengthwise threads in the area of the overlap.

In any case, a woven base fabric, taking the form of an endless loop and having an inner surface, a longitudinal (machine) direction (MD) and a transverse (cross-machine) direction (CD), is the result. The lateral edges of the woven base fabric are then trimmed to render them parallel to its longitudinal (machine) direction. The angle between the machine direction of the woven base fabric and the helically continuous seam may be relatively small, that is, typically less than 10°. By the same token, the lengthwise (warp) yams of the woven fabric strip make the same relatively small angle with the longitudinal (machine) direction of the woven base fabric. Similarly, the crosswise (filling) yams of the woven fabric strip, being perpendicular to the lengthwise (warp) yams, make the same relatively small angle with the transverse (cross-machine) direction of the woven base fabric. In short, neither the lengthwise (warp) nor the crosswise (filing) yams of the woven fabric strip align with the longitudinal (machine) or transverse (cross-machine) directions of the woven base fabric.

In the method shown in U.S. Pat. No. 5,360,656, the woven fabric strip is wound around two parallel rolls to assemble the woven base fabric. It will be recognized that endless base fabrics in a variety of widths and lengths may be provided by spirally winding a relatively narrow piece of woven fabric strip around the two parallel rolls, the length of a particular endless base fabric being determined by the length of each spiral turn of the woven fabric strip, and the width being determined by the number of spiral turns of the woven fabric strip. The prior necessity of weaving complete base fabrics of specified lengths and widths to order may thereby be avoided. Instead, a loom as narrow as 20 inches (0.5 meters) could be used to produce a woven fabric strip, but, for reasons of practicality, a conventional textile loom having a width of from 40 to 60 inches (1.0 to 1.5 meters) may be preferred.

U.S. Pat. No. 5,360,656 also shows a press fabric comprising a base fabric having two layers, each composed of a spirally wound strip of woven fabric. Both layers take the form of an endless loop, one being inside the endless loop formed by the other. Preferably, the spirally wound strip of woven fabric in one layer spirals in a direction opposite to that of the strip of woven fabric in the other layer. That is to say, more specifically, the spirally wound strip in one layer defines a right-handed spiral, while that in the other layer defines a left-handed spiral. In such a two-layer, laminated base fabric, the lengthwise (warp) yarns of the woven fabric strip in each of the two layers make relatively small angles with the longitudinal (machine) direction of the woven base fabric, and the lengthwise (warp) yarns of the woven fabric strip in one layer make an angle with the lengthwise (warp) yarns of the woven fabric strip in the other layer. Similarly, the crosswise (filling) yarns of the woven fabric strip in each of the two layers make relatively small angles with the transverse (cross-machine) direction of the woven base fabric, and the crosswise (filling) yarns of the woven fabric strip in one layer make an angle with the crosswise (filling) yarns of the woven fabric strip in the other layer. In short, neither the lengthwise (warp) nor the crosswise (filling) yarns of the woven fabric strip in either layer align with the longitudinal (machine) or transverse (cross-machine) directions of the base fabric. Further, neither the lengthwise (warp) nor the crosswise (filling) yarns of the woven fabric strip in either layer align with those of the other.

As a consequence, the base fabrics shown in U.S. Pat. No. 5,360,656 have no defined machine or cross-machine direction yarns. Instead, the yarn systems lie in directions at oblique angles to the machine and cross-machine directions. A press fabric having such a base fabric may be referred to as a multi-axial press fabric. Whereas the standard press fabrics of the prior art have three axes: one in the machine direction (MD), one in the cross-machine direction (CD), and one in the Z-direction, which is through the thickness of the fabric, a multi-axial press fabric has not only these three axes, but also has at least two more axes defined by the directions of the yarn systems in its spirally wound layer or layers. Moreover, there are multiple flow paths in the Z-direction of a multi-axial press fabric. As a consequence, a multi-axial press fabric has at least five axes. Because of its multi-axial structure, a multi-axial press fabric having more than one layer exhibits superior resistance to nesting and/or to collapse in response to compression in a press nip during the papermaking process as compared to one having base fabric layers whose yarn systems are parallel to one another.

Turning now to the fine, nonwoven fibrous material needled into the base fabric in the production of a contemporary press fabric, many such press fabrics are manufactured with a so-called stratified batt structure.

Stratified batt structures comprise a plurality of batt layers, each of which consists of fibers of a different denier. Typically, a layer or layers of fibrous batt material, consisting of relatively coarse fibers, is needled into the base fabric first. Then, a layer or layers of fibrous batt material consisting of finer fibers are applied over the layers of coarser fibers. The result is a press fabric having high air and water permeability, due to the coarse fibers in the interior batt layers, and a smooth pressing surface with a high degree of pressure uniformity, due to the fine fibers on the surface.

Preferably, the pressing surface of the press fabric will be free of needle tracks, the spaces or holes left where the barbed needles used in the needling process have penetrated the surface. In order to remove the needle tracks from the surface of the press fabric, it is common to needle it from the other side, so that the needles will force batt fiber from within the press fabric outward to fill the needle tracks and smooth the surface of the press fabric. Unfortunately, where the press fabric has a stratified batt structure, this reverse needling forces coarse fibers from within the press fabric to the surface. This compromises the smooth pressure distribution otherwise obtained by the fine surface layer, since coarse fibers are brought up to the surface, and makes it difficult to provide a stratified press fabric that is free of needle tracks.

Further, paper machine clothing wears out and requires replacement through normal use. For stratified press fabrics, the surface of the fabric is typically worn down/away thereby exposing the underlying layers/structure of the fabric. Such surface wear often results in a reduction in the quality of the produced paper (e.g. a worn fabric may cause marking of the paper). Hence, paper machine clothing must be replaced when worn. Accordingly, a technique is needed for detecting wear in paper machine clothing, including stratified press fabrics, so that the fabrics may be replaced at the appropriate time.

The present invention provides a solution to these problems of the prior art.

SUMMARY OF THE INVENTION

Accordingly, the present invention is a stratified press fabric for the press section of a paper machine having a passive sensor system for detecting wear in the press fabric. The lower (non-surface) layer(s) of the stratified press fabric are produced using colored staple fiber batt material. As the surface of the fabric is worn away through use, the colored batt material is exposed to provide a visual indication of the wear. This visual indication allows the customer to readily determine the appropriate time to replace the press fabric.

The present stratified press fabric comprises a base fabric, which is in the form of an endless loop having an outer side and an inner side. A first staple fiber batt material is attached to the outer side of the base fabric. The first staple fiber batt material is composed of a plurality of first staple fibers that are colored to indicate wear when the material is exposed.

A fine fabric is disposed over the first staple fiber batt material on the outer side of the base fabric, and a second staple fiber batt material is attached to the fine fabric. The second staple fiber batt material is composed of a plurality of second staple fibers which are finer, that is, of smaller diameter or denier, than those of the plurality of first staple fibers. Further, these second staple fibers are either not colored or are differently colored than the first staple fibers.

The first staple fiber batt material is generally attached to the outer side of the base fabric by needling. Similarly, the second staple fiber batt material is generally attached to the fine fabric in the same manner. Inevitably, some needle tracks will remain on the surface of the second staple fiber batt material at the conclusion of the needling process. The number and size of the needle tracks may be diminished by needling from the inner side of the base fabric. With the present invention, the fine fabric, which has openings no larger than 0.50 mm in any dimension, prevents the coarser fibers of the plurality of first staple fibers from being transported up to the paper-contacting surface of the press fabric.

The present invention will now be described in more complete detail, with frequent reference being made to the figures identified below.

DETAILED DESCRIPTION OF THE PREFERRED EMBODIMENTS

Figure 1:
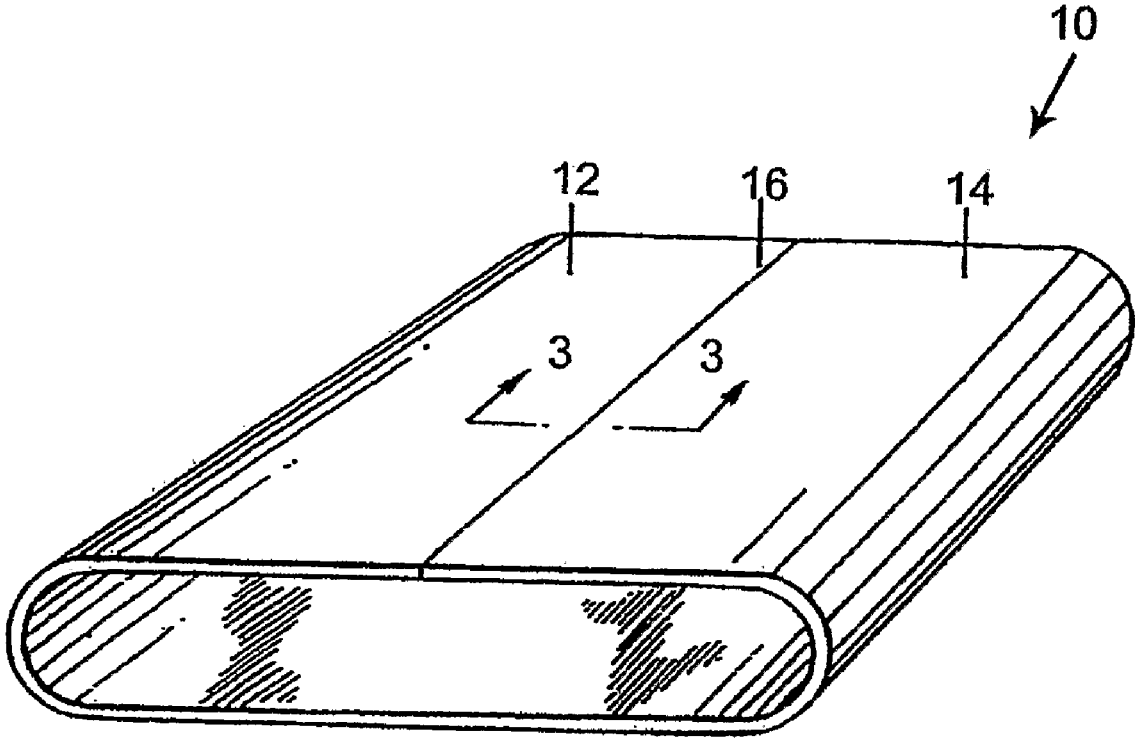
FIG. 1 is a schematic perspective view of the stratified press fabric of the present invention.

Turning now to these figures, FIG. 1 is a schematic perspective view of the press fabric 10 of the present invention. Press fabric 10 is of the on-machine-seamable variety and takes the form of an endless loop once its two ends 12,14 have been joined to one another at seam 16.

Figure 2:
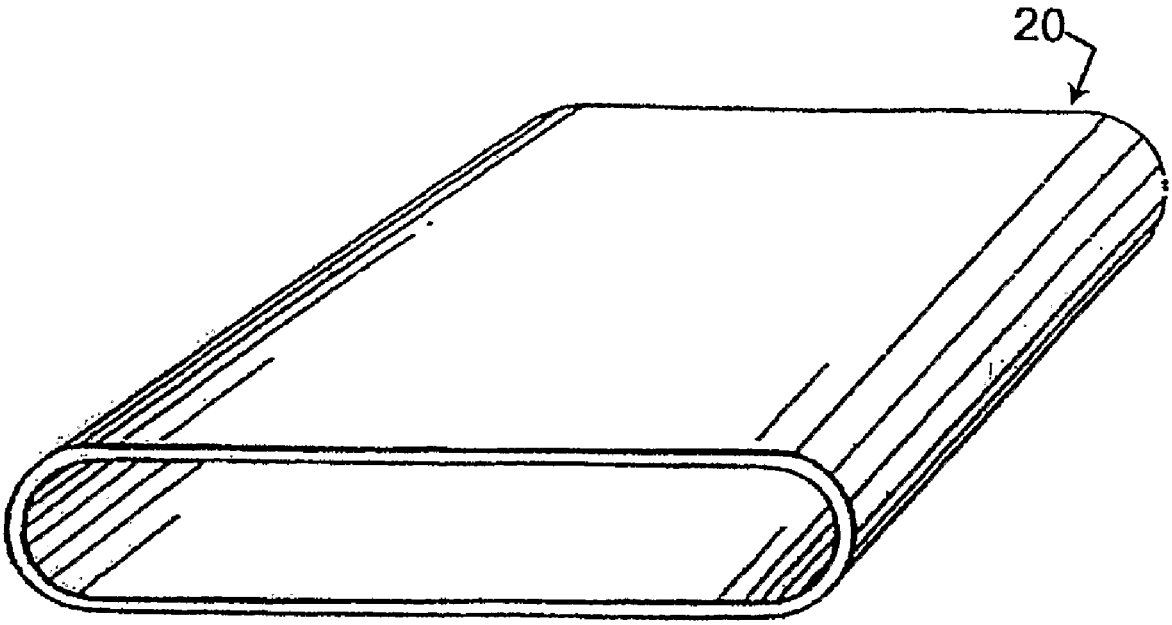
FIG. 2 is a like view of an alternate embodiment thereof.

In an alternate embodiment, as shown in schematic perspective view in FIG. 2, press fabric 20 has no seam and is in the form of an endless loop.

Figure 3:
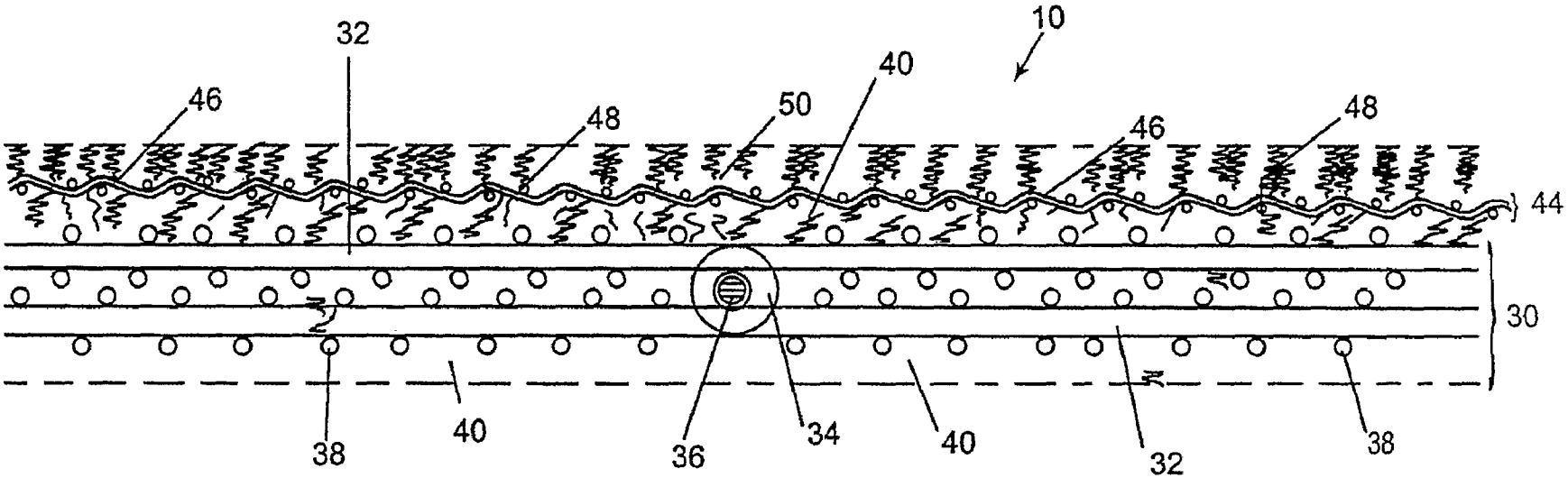
FIG. 3 is a cross-sectional view taken as indicated by line 3-3 in FIG. 1.

FIG. 3 is a cross-sectional view taken as indicated by line 3-3 in FIG. 1. Press fabric 10 includes a base fabric 30. In general, the base fabric 30 may be a woven, nonwoven, nonwoven arrays of MD or CD oriented yarns, knitted or braided structure of yarns of the varieties used in the production of paper machine clothing, such as monofilament, plied monofilament and/or multifilament yarns extruded from polymeric resin materials. Resins from the families of polyamide, polyester, polyurethane, polyaramid and polyolefin resins may be used for this purpose.

The base fabric 30 may alternatively be composed of mesh fabrics, such as those shown in commonly assigned U.S. Pat. No. 4,427,734 to Johnson, the teachings of which are incorporated herein by reference. Further, the base fabric 30 may be produced by spirally winding a strip of woven, nonwoven, knitted, braided or mesh material according to the methods shown in commonly assigned U.S. Pat. No. 5,360,656 to Rexfelt et al., the teachings of which are incorporated herein by reference. The base fabric 30 may accordingly comprise a spirally wound strip, wherein each spiral turn is joined to the next by a continuous seam making the base fabric 30 endless in a longitudinal direction.

The base fabric 30 may be endless, or, as shown in FIG. 3, on-machine-seamable. As shown, base fabric 30 is woven from monofilament yams in a two-layer, or duplex, weave. Machine-direction yarns 32, which are the weft yarns in the on-machine-seamable base fabric 30, form seaming loops 34 which are interdigitated to create a passage through which a pintle 36 is directed to join the base fabric 30 into endless form. Cross-machine direction yams 38, which are the warp yarns during the weaving of the base fabric 30, are, like the machine-direction yarns 32, shown to be monofilament yarns for the purposes of illustration.

One or more layers of staple fiber batt material 40 are applied to the outside of base fabric 30, and optionally to the inside as well, and constituent fibers thereof are driven into base fabric 30 by needling. The attachment is effected so as to leave a layer of staple fiber batt material 40 on the outside, and optionally on the inside, of the base fabric 30.

A fine fabric 44 is then disposed on the staple fiber batt material 40 on the outside of the base fabric 30. The fine fabric 44 may be woven or nonwoven, and may be endless, flat-woven or spiraled onto the staple fiber batt material 40. As depicted in FIG. 3, the fine fabric 44 is of a single layer weave, such as the plain weave shown, of machine-direction yarns 46 and cross-machine-direction yarns 48, both of which may be monofilament yarns. However, yarns other than monofilament yarns may be used in the weaving of the fine fabric 44. Both the yarns 46,48 and the mesh formed by the woven structure of fine fabric 44 are finer than those of base fabric 30.

More generally, fine fabric 44, like base fabric 30, may be a woven, nonwoven, nonwoven arrays of MD or CD oriented yarns, knitted or braided structure of yarns of the varieties used in the production of paper machine clothing, such as monofilament, plied monofilament and/or multifilament yarns extruded from polymeric resin materials. Resins from the families of polyamide, polyester, polyurethane, polyaramid and polyolefin resins may be used for this purpose.

Fine fabric 44 may alternatively be composed of mesh fabrics, such as those shown in commonly assigned U.S. Pat. No. 4,427,734 to Johnson, the teachings of which are incorporated herein by reference. Further, the fine fabric 44 may be produced by spirally winding a strip of woven, nonwoven, knitted, braided or mesh material according to the methods shown in commonly assigned U.S. Pat. No. 5,360,656 to Rexfelt et al., the teachings of which are incorporated herein by reference. The fine fabric 44 may accordingly comprise a spirally wound strip, wherein each spiral turn is joined to the next by a continuous seam making the fine fabric 44 endless in a longitudinal direction.

If fine fabric 44 is endless, it may be disposed on staple fiber batt material 40 in the manner of a sleeve or sock. Moreover, where fine fabric 44 is endless, or spiraled onto staple fiber batt material 40 in accordance with the teachings of U.S. Pat. No. 5,360,656, and base fabric 30 is on-machine-seamable as depicted in FIG. 3, it will ultimately be necessary to cut fine fabric 44 transversely in the vicinity of the seam formed by seaming loop 34 and pintle 36 to enable the press fabric 10 to be installed on a paper machine, as is well known to those of ordinary skill in the art.

In any event, fine fabric 44 is so called because its component yarns and/or mesh material are finer (smaller size or diameter, thinner or of smaller denier) that those of base fabric 30, and its mesh is finer than that of base fabric 30. As an example, the fine fabric 44 may have openings no larger than 0.50 mm in any dimension.

Finally, one or more layers of staple fiber batt material 50 are applied to the outside of fine fabric 44, and constituent fibers thereof are driven into and entangled within fine fabric 44 by needling. The attachment is effected so as to leave a layer of staple fiber batt material 50 on the outside of the fine fabric 44.

Staple fiber batt material 40 and staple fiber batt material 50 may comprise staple fibers of any polymeric resin used in the production of paper machine clothing, but are preferably of a polyamide resin. The staple fibers making up staple fiber batt material 50 may have a smaller cross-sectional size or diameter or denier than those of staple fiber batt material 40. For example, the staple fibers of stable fiber batt material 50 may be of 6 denier, while staple fibers of staple fiber batt material 40 may be of 24 denier.

In contrast to the stratified press fabrics of the prior art, the fine fibers of staple fiber batt material 50 are separated from the relatively coarser fibers of staple fiber batt material 40 by fine fabric 44. The fine fabric 44 limits the amount by which the fine fibers of staple fiber batt material 50 penetrate into staple fiber batt material 40 and base fabric 30 during the needling of staple fiber batt material 50.

Moreover, when the backside of the press fabric 10 is needled, following the attachment of staple fiber batt material 50 to the face side, the fine mesh of fine fabric 44 prevents the transport of the relatively coarser staple fibers of staple fiber batt material 40 into the staple fiber batt material 50.

In the stratified press fabrics of the prior art, the fine fiber portion may be as great as 75% fine fiber after needling, while the coarse fiber portion may be as great as 75% coarse fibers, with the remaining 25% of the fibers in each portion being fibers of the opposite kind, driven thereinto by the needling. There is also an intermediate region at the interface between the fine and coarse fiber portions where the fine and coarse fibers are mixed. The present invention may eliminate or substantially reduce this mixing. As a result, there may be little or no coarse fibers of staple fiber batt material 40 on the face side of the press fabric 10.

In addition, fine fabric 44 provides press fabric 10 with added compaction resistance while minimally impeding water flow.

Among the advantages of the present stratified press fabric 10 are its superior smoothness characteristics, which result from its homogeneous layer of face side batt. This surface layer imparts a smoother surface to the wet paper web it contacts within a press nip.

The present stratified press fabric 10 minimizes rewet because the homogeneous layer of fine face side batt permits less water to return to the paper web following exit from a press nip compared to the press fabrics of the prior art. The same uniformity of the pressing surface maximizes the dryness of the paper sheet following exit from the nip. Moreover, the fine, homogeneous, smooth face side batt makes the press fabric 10 less prone to sheet blowing upon approach to a press nip, and reduces sheet marking because of its lack of needle tracks.

Of course, the fine fabric 44 is desirably "fine" enough not to mark a paper web through the staple fiber batt material 50 needled thereover, and to prevent relatively coarse staple fiber batt material 40 from mixing with the relatively fine staple fiber batt material 50 during the needling process. Furthermore, the fine fabric 44 may be "fine" enough to inhibit the transport of fibers 50 therethrough and have enough structural integrity to withstand the needling process.

Additionally, fine fabric 44 may be woven or knitted structures produced using yams (warp and weft) having diameters in the range from 0.04 mm to 0.50 mm. Such yams may have the same or different diameters or deniers. Further, the yarns may be extruded from polyamide, polyurethane, polyethylene terephthalate (PET), polybutylene terephthalate (PBT), polyolefin and other polymeric resins commonly used for this purpose by those of ordinary skill in the art.

As an example, the fine fabric 44 may be woven from 0.25 mm polyamide warp yams and 0.25 mm polyamide weft yams, and have eighteen (18) of each per centimeter. Such fabric may have openings, which are approximately 0.30 mm by 0.30 mm, and which are sufficiently small to prevent the needling of coarse batt fibers therethrough from the inner side of the base fabric.

In another example, the fine fabric 44 may be woven from 0.19 mm polyethylene monofilament warp yarns and 0.25 mm polyethylene monofilament weft yams, at a density of 21.4 warp yarns per centimeter and 18 weft yams per centimeter. Such fabric may have openings which are approximately 0.28 mm by 0.30 mm.

Fine fabric 44 may alternatively be extruded of molded films, and may be perforated or unperforated. In the latter case, perforations will be made during the needling process. Nonwovens or spun-bonded materials may also be used.

Furthermore, this stratified/layered approach can be used to provide a passive sensor system for detecting wear in the press fabric. Namely, the lower (non-surface) layers of the stratified fabric can be produced using colored batt material. As the surface of the fabric is worn away by use, the colored batt material is exposed to provide a visual indication of the wear. For example, the stratified press fabric shown in FIG. 3 may comprise a white colored base fabric 30, a blue colored coarse staple fiber batt layer 40, a red colored fine fabric 44, and a white colored staple fiber batt material 50 forming the surface layer. During use, the white surface layer 50 will begin to wear away, thereby exposing the underlying red fine fabric 44 and/or blue coarse batt layer 40. This visual indication allows the customer to readily determine the appropriate time to replace the press fabric. This visual indication may be any color (e.g. a dark blue or red batt layer with a white surface layer). Alternatively, UV visible coloring may be used so that the fabric appears to be white, but black light can be used to detect for wear.

Modifications to the above would be obvious to those of ordinary skill in the art, but would not bring the invention so modified beyond the scope of the appended claims.

What is claimed is:

1. A stratified press fabric for the press section of a paper machine, comprising:

a base fabric in the form of an endless loop having an outer side and an inner side;

a first batt layer attached to the outer side of said base fabric;

a fine fabric covering said first batt layer; and a second batt layer attached to said fine fabric;

wherein said first batt layer has staple fiber batt material that is coarser and of a first color different than said second batt layer; said first color indicating wear when said second batt layer is worn such that the first batt layer is exposed;

wherein said fine fabric limits transfer of staple fiber batt material between said first and second batt layers.

2. The stratified press fabric according to claim 1, wherein said fine fabric is a second color different than said second batt layer; said second color indicating wear when said second batt layer is worn such that the fine fabric is exposed.

3. The stratified press fabric according to claim 1, further comprising a plurality of batt layers between said base fabric and said fine fabric; said plurality of batt layers having at least one layer of said first color for indicating wear.

4. The stratified press fabric according to claim 1, wherein said first color is visible in ultraviolet light.

5. A stratified press fabric for the press section of a paper machine, said press fabric comprising:

a base support structure, said base support structure being in the form of an endless loop and having an outer side and an inner side;

a first staple fiber batt material attached to said outer side of said base support structure, said first staple fiber batt material comprising a plurality of first staple fibers of a first color;

a fine fabric, said fine fabric covering said first staple fiber batt material on said outer side of said base support structure; and a second staple fiber batt material attached to said fine fabric, said second staple fiber batt material comprising a plurality of second staple fibers of a second color different than said first color, said second staple fibers being finer than said first staple fibers;

wherein said first color indicates wear when said second staple fiber batt material is worn such that the first staple fiber batt material is exposed;

wherein said fine fabric limits transfer of said first staple fibers and said second staple fibers therethrough and intermingling of said first staple fibers and said second staple fibers.

6. A stratified press fabric as claimed in claim 5 wherein said base support structure is a fabric selected from the group consisting of woven, nonwoven, nonwoven arrays of MD or CD oriented yarns, knitted and braided fabrics.

7. A stratified press fabric as claimed in claim 6 wherein said base support structure is an extruded mesh fabric.

8. A stratified press fabric as claimed in claim 5, wherein said base support structure is a strip of material spirally wound in a plurality of turns, each turn being joined to those adjacent thereto by a continuous seam, said base support structure being endless in a longitudinal direction, said strip material being selected from the group consisting of woven fabrics, nonwoven fabrics, knitted fabrics, braided fabrics and extruded mesh fabrics.

9. A stratified press fabric as claimed in claim 5, wherein said base support structure is an on-machine-seamable fabric.

10. A stratified press fabric as claimed in claim 5, wherein said fine fabric is a fabric selected from the group consisting of woven, nonwoven, knitted and braided fabrics.

11. A stratified press fabric as claimed in claim 10, wherein said fine fabric is an extruded mesh fabric.

12. A stratified press fabric as claimed in claim 5, wherein said fine fabric is a strip material spirally wound in a plurality of turns, each turn being joined to those adjacent thereto by a continuous seam, said fine fabric being endless in a longitudinal direction, said strip material being selected from the group consisting of woven fabrics, nonwoven fabrics, knitted fabrics, braided fabrics and extruded mesh fabrics.

13. A stratified press fabric as claimed in claim 5, wherein said fine fabric is an endless fabric.

14. A stratified press fabric as claimed in claim 5, wherein said first staple fibers have a first diameter and said second staple fibers have a second diameter which is smaller than said first diameter.

15. A stratified press fabric as claimed in claim 5, wherein said first staple fibers have a first cross-sectional size and said second staple fibers have a second cross-sectional size which is smaller than said first cross-sectional size.

16. A stratified press fabric as claimed in claim 5, wherein said fine fabric has openings no larger than 0.50 mm in any dimension, so that said first staple fibers are not driven therethrough when said stratified press fabric is needled from said inner side of said base support structure.

17. A stratified press fabric as claimed in claim 5, wherein said support structure is comprised of two or more bases selected from the group consisting of woven, nonwoven, nonwoven arrays of MD or CD yarns, knitted, braided, extruded meshes of film structures.

* * * * *